US007481032B2

(12) United States Patent
Tarr

(10) Patent No.: US 7,481,032 B2
(45) Date of Patent: Jan. 27, 2009

(54) STUD SYSTEM FOR INSULATION OF CONCRETE STRUCTURES

(76) Inventor: Neil Tarr, 143 Hawkwood Blvd. N.W., Calgary, Alberta (CA) T3G 2X8

( * ) Notice: Subject to any disclaimer, the term of this patent is extended or adjusted under 35 U.S.C. 154(b) by 502 days.

(21) Appl. No.: 10/829,356

(22) Filed: Apr. 22, 2004

(65) Prior Publication Data

US 2005/0241250 A1 Nov. 3, 2005

(51) Int. Cl.
*E04G 17/06* (2006.01)
*E04B 2/00* (2006.01)

(52) U.S. Cl. ..... 52/404.2; 52/506.07; 52/512; 52/713; 52/383

(58) Field of Classification Search ..... 52/713, 52/267, 268, 269, 506.01, 506.05, 512, 383, 52/378, 506.02, 481.1, 344, 351, 600, 601, 52/432, 414, 729.5, 729.1, 696, 464, 460, 52/468, 287.1, 506.07, 731.5, 731.9, 733.2, 52/169.11, 407.3, 318, 309.7, 506.08, 404.1, 52/504.2, 404.4, 695; D25/132
See application file for complete search history.

(56) References Cited

U.S. PATENT DOCUMENTS

| | | | | | |
|---|---|---|---|---|---|
| 2,276,040 | A * | 3/1942 | Hull | 52/377 |
| 3,083,794 | A * | 4/1963 | Stovall, Jr. | 52/364 |
| 3,394,507 | A * | 7/1968 | Doke | 52/36.6 |
| 3,452,960 | A * | 7/1969 | Bowden | 249/40 |
| 3,509,669 | A * | 5/1970 | Plemeng | 52/36.6 |
| 3,556,452 | A * | 1/1971 | Ramsey et al. | 248/228.5 |
| 3,730,476 | A | 5/1973 | Prichard, Jr. | |
| 3,744,826 | A * | 7/1973 | Hawes | 52/733.4 |
| 4,074,478 | A * | 2/1978 | Rutherford | 52/98 |
| 4,197,952 | A * | 4/1980 | De Fouw et al. | 211/191 |
| 4,433,517 | A * | 2/1984 | Moore, Jr. | 52/204.55 |
| 5,243,797 | A * | 9/1993 | Koenig, Jr. | 52/254 |
| 5,265,998 | A * | 11/1993 | Kluser | 411/480 |
| 5,415,510 | A * | 5/1995 | Funaki et al. | 411/384 |
| 5,459,970 | A * | 10/1995 | Kim | 52/424 |
| 5,477,643 | A * | 12/1995 | Koenig, Jr. | 52/100 |
| 5,611,183 | A * | 3/1997 | Kim | 52/426 |
| 5,644,889 | A * | 7/1997 | Getz | 52/713 |
| 5,664,380 | A * | 9/1997 | Hsueh | 52/126.4 |
| 5,671,576 | A * | 9/1997 | Kluser | 52/512 |
| 5,819,489 | A | 10/1998 | McKinney | |
| 5,848,512 | A * | 12/1998 | Conn | 52/729.1 |
| 6,125,605 | A * | 10/2000 | Young | 52/717.01 |
| 6,243,999 | B1 * | 6/2001 | Silverman | 52/204.51 |
| 6,434,902 | B1 | 8/2002 | Westra | |

(Continued)

FOREIGN PATENT DOCUMENTS

| | | |
|---|---|---|
| CA | 2107426 | 3/1994 |
| CA | 1329013 | 5/1994 |
| CA | 2006469 | 7/1996 |
| CA | 2306966 | 10/2001 |

*Primary Examiner*—Robert J Canfield
*Assistant Examiner*—Jessie Fonseca
(74) *Attorney, Agent, or Firm*—Andrew Hicks; Hicks & Associates

(57) ABSTRACT

A stud system for supporting spray insulation to an exterior surface of a concrete structure is disclosed. The stud includes a wall abutting surface, and a laterally extending web for promoting adherence of foam insulation when applied to either side of the stud. The stud is attached to the structure by anchoring to one or more form ties protruding from the structure, or by driving fasteners into the structure. The stud also includes a second surface which can be used for attachment of exterior finishes such as vinyl siding or stucco.

9 Claims, 7 Drawing Sheets

U.S. PATENT DOCUMENTS

| | | | | |
|---|---|---|---|---|
| 6,647,686 | B2 | 11/2003 | Dunn et al. | |
| 7,104,018 | B2 * | 9/2006 | Romes et al. | 52/405.1 |
| 2001/0002528 | A1 | 6/2001 | Fust, III | |
| 2002/0124508 | A1 | 9/2002 | Dunn et al. | |
| 2002/0178676 | A1 | 12/2002 | Yost et al. | |
| 2003/0033782 | A1 | 2/2003 | Schmidt | |

* cited by examiner

STUD SYSTEM FOR INSULATION OF CONCRETE STRUCTURES

FIELD OF THE INVENTION

The present invention relates generally to the insulation of concrete structures. More particularly, the present invention relates to a system for supporting spray foam insulation to an exterior surface of a concrete wall.

BACKGROUND OF THE INVENTION

In the construction of concrete structures, such as building foundations and concrete walls, it is often desirable to provide Insulation to the exterior surface of the concrete. In the industry, exterior insulation is usually preferred over interior insulation in that it generally permits complete coverage of the structure without the difficulty of running service conduits such as plumbing and electrical wiring through the insulation, as is required with interior insulation. Moreover, exterior insulation can be completed without entering the structure and does not reduce interior floor space.

Exterior insulation is also advantageous over interior insulation in that it reduces temperature fluctuations in the concrete wall, can improve the energy efficiency of the building as well as reducing noise travel through the walls of the structure. Still further, and in the particular case where aluminium forms are used for creating the structure, when the exterior surface of a concrete wall has been insulated, the interior surface of the concrete foundation, by virtue of the smooth finished surface that an aluminium form provides, requires only light plastering to provide a finished wall surface on the Interior of the structure.

As is known, when a concrete foundation or building Is constructed, concrete is poured between removable forms that are held in place by a two-dimensional array of metal ties passing through the forms that hold and support the forms until the concrete has set. After the forms are removed, the ends of the metal ties are broken off at the surface of the structure to provide a smooth wall. The interior and/or exterior surface of the structure may be insulated by various methods using different types of insulation. Such methods may include affixing rigid insulation panels to the interior or exterior surface of the concrete wall, spraying foam onto the exterior surfaces or by building supporting walls for holding flexible insulation bats. For example, U.S. Pat. No. 6,434,902 teaches the fastening of caps to form ties of a concrete wall to hold the rigid insulation panels against the concrete wall.

One drawback of rigid insulation panel systems, particularly in the residential construction industry, is the difficulty in anchoring exterior finishing surfaces such as vinyl siding to the exterior surface of the insulated structure. In addition, the panels are awkward to transport and manoeuvre into place, often requiring the panels to be slid past a retaining system or to be held in place while a retaining system is affixed to the structure.

More recently, the residential construction industry has benefited from the development of Insulating Concrete Form (ICF) systems, in which rigid insulation panels are stacked and held in place by plastic or metal ties to create a form into which concrete is poured. In the finished structure, the ties extend through the foam to provide a nailing strip to enable the attachment of drywall to the interior surface, and exterior finish (such as vinyl siding) to the exterior surface of the wall.

The prior art includes examples of ICF systems, such as U.S. Patent Application No. 2002/0124508 and U.S. Pat. No. 6,647,686, which disclose a stud system for attachment to insulating concrete forms prior to pouring of the concrete. Spreaders are attached to the studs to hold apart the insulated panels until the concrete cures.

U.S. Pat. No. 5,819,489 discloses a flow-through stud system for use between the panels of an insulating concrete form system. The studs, when assembled, are generally I-shaped and have a web-like structure to allow newly poured concrete to disperse through the stud system. The insulated concrete forms are left in place to become the exterior surface of the wall.

U.S. Patent Application No. 2001/0002528 discloses a spacing web frame assembly or stud system for holding apart insulating concrete forms. The studs are connected by a reinforcing wire web that extends from one stud to the other, thereby holding apart the forms and allowing concrete to be poured between the forms.

U.S. Patent Application No. 2003/0033782 discloses a wall tie bracket for providing spacing between insulating concrete forms, replacing the need for form ties and creating a void between the forms into which concrete is poured.

U.S. Pat. No. 3,730,476 discloses a system for forming concrete. The studs used with the system are generally extruded U-shaped metal studs, and are provided with spaced apart holes to accommodate snap ties which extend therethrough and are releasably held by ordinary fastening wedges. The studs are removed following curing of the concrete, and are not intended to support exterior insulation or exterior finishes.

U.S. Patent Application No. 2002/0178676 discloses a method to assemble insulating concrete forms such that the forms (with attached studs) are held in place while the concrete is poured.

In general, ICF's are costly and somewhat fragile, so care must be taken during concrete pouring to prevent bulging, shifting or breakage of the ICF's. Moreover, the limited strength of ICF's does not allow for proper vibration of the forms to consolidate the concrete, resulting in voids and honeycomb within the finished concrete structure. The forms are also generally of an awkward size, making transport and storage inconvenient.

It is therefore desirable to provide an improved system for insulating the surfaces of concrete structures that enhances the application of spray foam to a concrete surface to both support the insulation and provide further finishing options.

SUMMARY OF THE INVENTION

In accordance with the invention, there is provided a stud comprising a first surface for abutting against a concrete wall, an anchoring system for anchoring the first surface to a form tie protruding from the concrete wall and a lateral web extending from the first surface for receiving and retaining insulation adjacent to the concrete wall.

In accordance with a further embodiment of the invention, there is provided a method for affixing a stud to a concrete wall, the method comprising the steps of placing a stud in proximity to a concrete wall such that the stud engages a form tie protruding from the concrete wall and anchoring the stud to the form tie. In further embodiments, the invention also provides spraying foam insulation against the wall and between the studs and/or attaching a finishing treatment to the stud.

In a still further embodiment, the invention provides a kit for applying insulation to the surface of a concrete wall, the kit comprising a plurality of studs for attachment to form ties protruding from the concrete wall, and a plurality of anchors for anchoring the studs to the form ties. In further embodiments of the kit, the kit includes an opening trim member, the opening trim member for operative engagement with a concrete wall adjacent an opening, the trim member including an abutting surface for abutting an opening in the concrete wall, an extension member extending angularly from the abutting surface a second extension member for supporting attachment of a finishing surface. The kit may further include a corner stud for attachment to a wall corner, the stud including first and second wall contacting surfaces and first and second web surfaces extending outwardly from the first and second wall contacting surfaces, the first and second web surfaces interconnected by a hinge.

BRIEF DESCRIPTION OF THE DRAWINGS

Embodiments of the present invention will now be described, by way of example, with reference to the attached Figures, wherein.

DETAILED DESCRIPTION OF THE INVENTION

Generally, the present invention provides a stud system for attachment to a new or existing concrete structure. The stud is used to support spray foam insulation against the concrete structure, while also providing an attachment surface for securing a finishing product to the structure.

Figure 1:
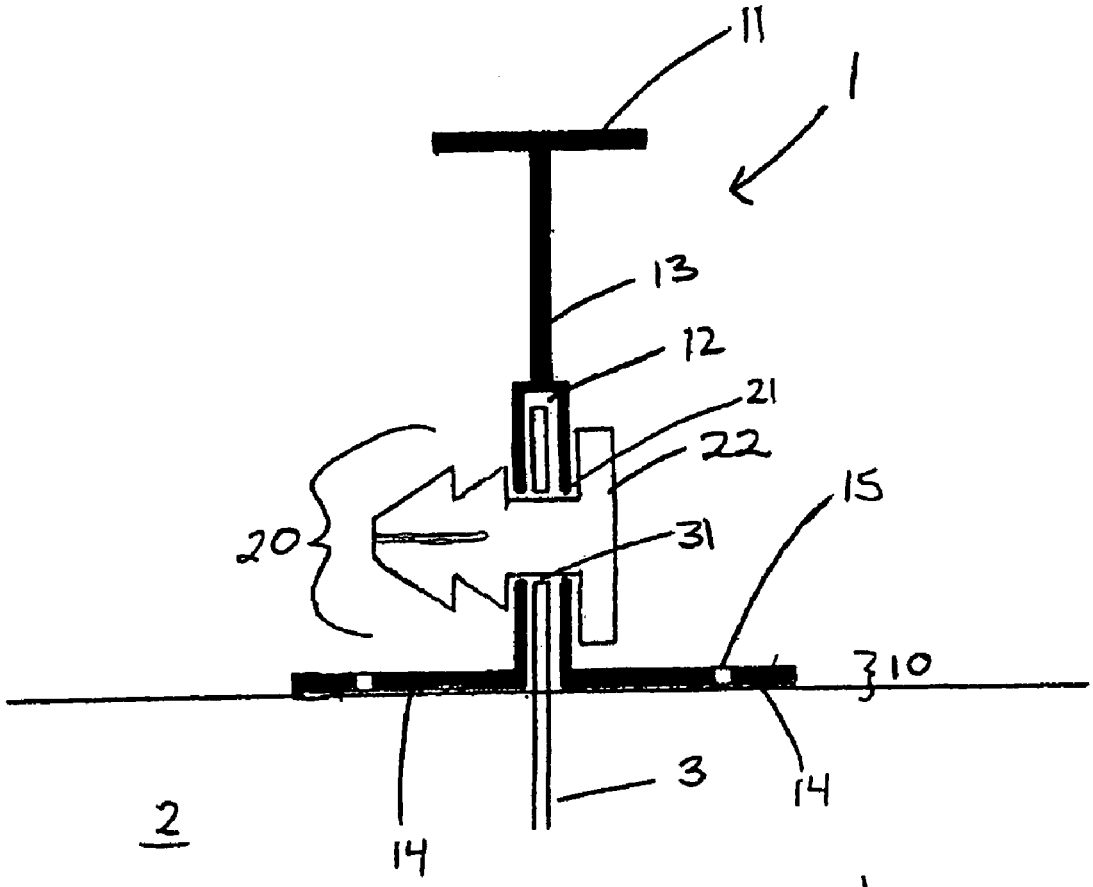
FIG. 1 is a cross sectional view of an embodiment of the invention as viewed from line A-A in FIG. 2.

As shown in the embodiment pictured in FIG. 1, a plastic stud 1, having first and second abutting surfaces 10, 11 and a connecting web 13, is anchored to a concrete wall 2 by an anchoring system 20.

As is known, form ties 3 generally protrude at regular intervals from either side of the concrete wall 2 following pouring and curing of the concrete. In a preferred embodiment, the stud 1 includes a form tie receptacle 12 for a receiving locking pin 22 through a form tie aperture 31 (collectively an anchoring system 20) for anchoring the stud 1 to the concrete wall 2.

Concrete forms generally have openings for securing form ties at regular intervals and, accordingly, it is preferred that the form tie receptacles 12 are formed within the stud 1 at industry standard intervals.

Figure 2:
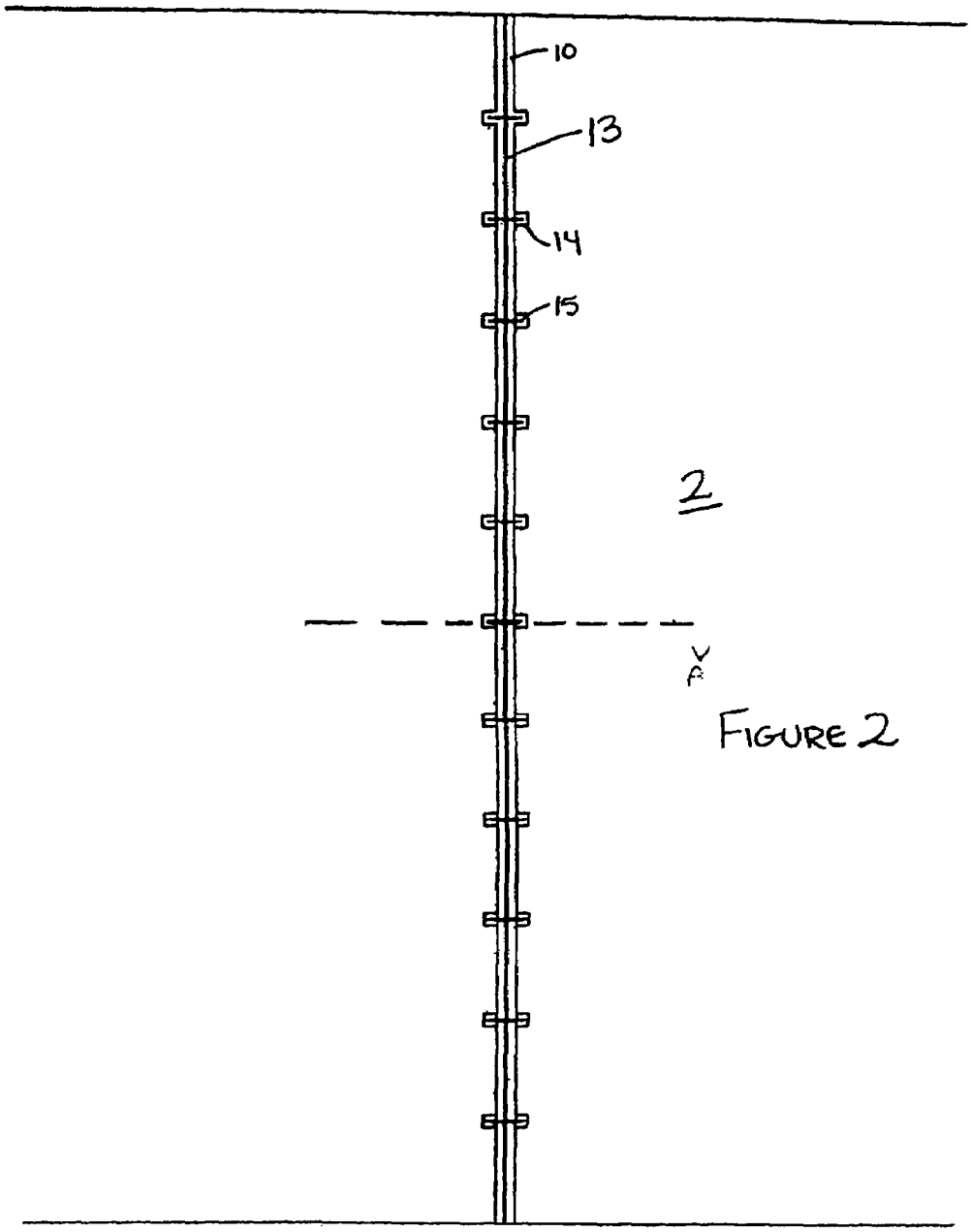
FIG. 2 is a front elevation of an embodiment of the invention.

As shown in FIG. 2, the first surface 10 is placed against a concrete wall 2, and includes extending flanges 14 for bracing the stud 1 against the wall 2. The flanges further include nailing apertures 15, for allowing the flanges to be secured to the wall 2, particularly when a form tie 3 is not present in the wall 2 at the desired stud location. A second surface 11 may further be provided to support the attachment of finishing treatments such as wallboard, vinyl siding, or stucco that may later be affixed to the structure.

Connecting Web

Figure 3:
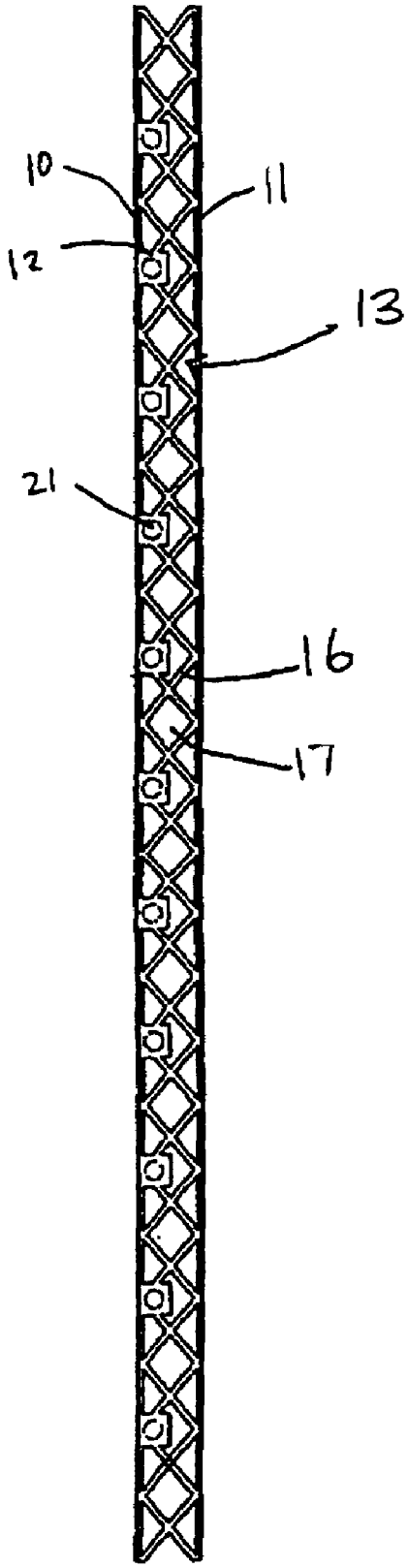
FIG. 3 is a side elevation of an embodiment of the invention.

The web 13, as shown in FIG. 3, connects the first and second surfaces 10 and 11, and supports a layer of insulation between the concrete wall 2 and the second abutting surface. The web 13 is designed to include cross members 16 and spaces 17 such that when a series of studs 1 have been attached to the wall 2, foam insulation can be sprayed between the studs, and insulation applied to one side of the stud 1 can communicate with and adhere to the insulation on the opposite side of the stud 1 due to the spaces 17 provided within the web 13, thereby supporting the insulation. The spaces are preferably of optimal size, shape, and/or number to ensure intermingling and adherence of the foam on both sides of the stud. Intermingling will result in improved insulative properties In the completed structure by reducing thermal bridging across the stud as well as improving the strength of the combined insulation and stud system for supporting a finishing surface.

Anchoring System

With reference to FIGS. 1 and 3, the form ties 3 that are typically used in the construction of concrete walls are lengths of metal with a hole 31 near one or both ends of the tie 3. The ties generally protrude a consistent distance from either side of the finished concrete wall, resulting in the tie holes 31 also being a set distance from the concrete surface. The form tie receptacle 12 of the stud 1 preferably have a depth consistent with the protruding length of the form tie 3, and the receptacle further includes an opening 21 for alignment with the tie holes 31.

The anchoring system 20 shown in FIG. 1 includes the form tie receptacle 12, the opening 21 within the receptacle 12, the tie hole 31, and a locking pin or anchor 22. A stud 1 is placed over one or a series of form ties 3, and each form tie 3 slides within a corresponding receptacle 12 until the flanges 14 brace the stud 1 against the concrete wall 2, at which point the opening 21 is aligned with the hole 31 in the form tie 3. A locking pin or anchor 22 is then inserted through the opening 21 and through the tie hole 31. The locking pin 22 may have fins or flanges to prevent removal of the pin 22 once inserted. The locking system may further include the attachment of nails, screws, or other fasteners through the nailing apertures 15 of the flanges 14 and into the wall 2.

Use of the Stud System

Prior to pouring of a concrete structure, the concrete forms are assembled, and form ties are used to maintain the positioning of the forms during pouring and curing of the concrete. As noted above, the form ties are preferably evenly spaced such that they are vertically aligned, horizontally spaced in accordance with accepted stud spacing distances, and protrude from the concrete wall to a consistent distance. After curing and removal of the forms, a stud in accordance with the invention is placed over vertically aligned form ties, with form ties engaging the receptacles 12 and associated anchoring system 20. The flanges 14 will abut the concrete wall 2, and the tie holes 31 will align with the receptacle openings 21, allowing placement of an anchor or pin 22 therethrough. If any receptacle 12 does not receive a form tie 3, or if a tie hole 31 does not properly align with its corresponding receptacle opening 21, the corresponding flanges 14 may instead be secured to the concrete wall by driving a nail, screw, or other fastener through the nailing apertures 15 within the flanges 14.

When a series of studs have been properly fastened to the concrete wall surface, foam insulation may be sprayed against the concrete wall 2. The insulation will fill the space between the webs 13 of each stud, and will bond or adhere on either side of the stud 1 due to the spaces 17 within the web 13 as well as to the concrete wall and any plumbing or electrical conduits or components. The studs will also provide a visual depth indicator to the sprayer so as to enable an even thickness coating to be applied.

Following application of insulation between the studs 1, the insulation may be trimmed such that it is flush with the second surface 11. A finishing treatment such as wallboard, siding, or stucco may then be applied to the wall by securing the finishing treatment to the second surfaces 11.

Studs for Specialty Applications

Figure 4A:
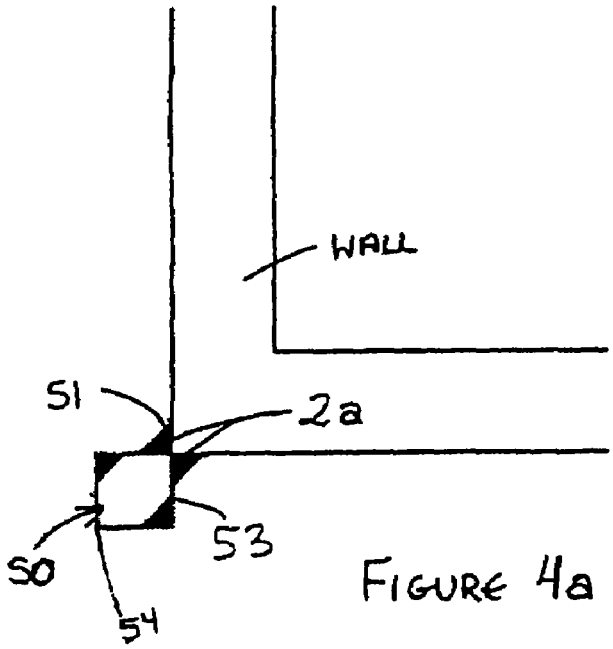
FIGS. 4*a* and 4*b* shows an embodiment of a corner stud in accordance with the invention.

When the stud system is applied to the exterior surface of a concrete structure such as a house, studs of various shapes, sizes, and configurations may be required. For example, a corner stud may be provided, as shown in FIG. 4*a*. The corner stud 50 shown is generally rectangular, and includes perpendicular surfaces for attachment to the corner surfaces 2*a* of a wall. As in the standard stud described above, the corner stud includes a web surface 53 that is substantially perpendicular to the dependent wall, and the stud may be attached to a protruding form tie or may be otherwise affixed to the corner 2*a* by driving nails, screws, or other fasteners through the flanges 51 and into the wall.

Figure 4B:
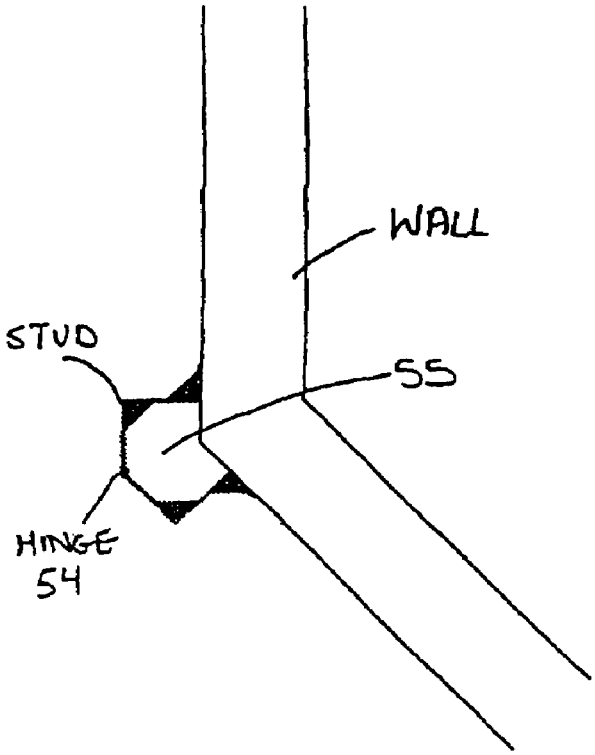

The corner studs may further be constructed with a hinged or otherwise adjustable joint 54, which allows the corner stud to be applied to a corner of any angle, as shown in FIG. 4*b*. It is noted that even when the corner stud is adjusted to accommodate an obtusely angled corner, the web surfaces will allow insulation to adhere on either side of the corner stud due to provision of a cavity 55, which may be filled with insulation, and is surrounded by web surfaces 53.

Figure 5:
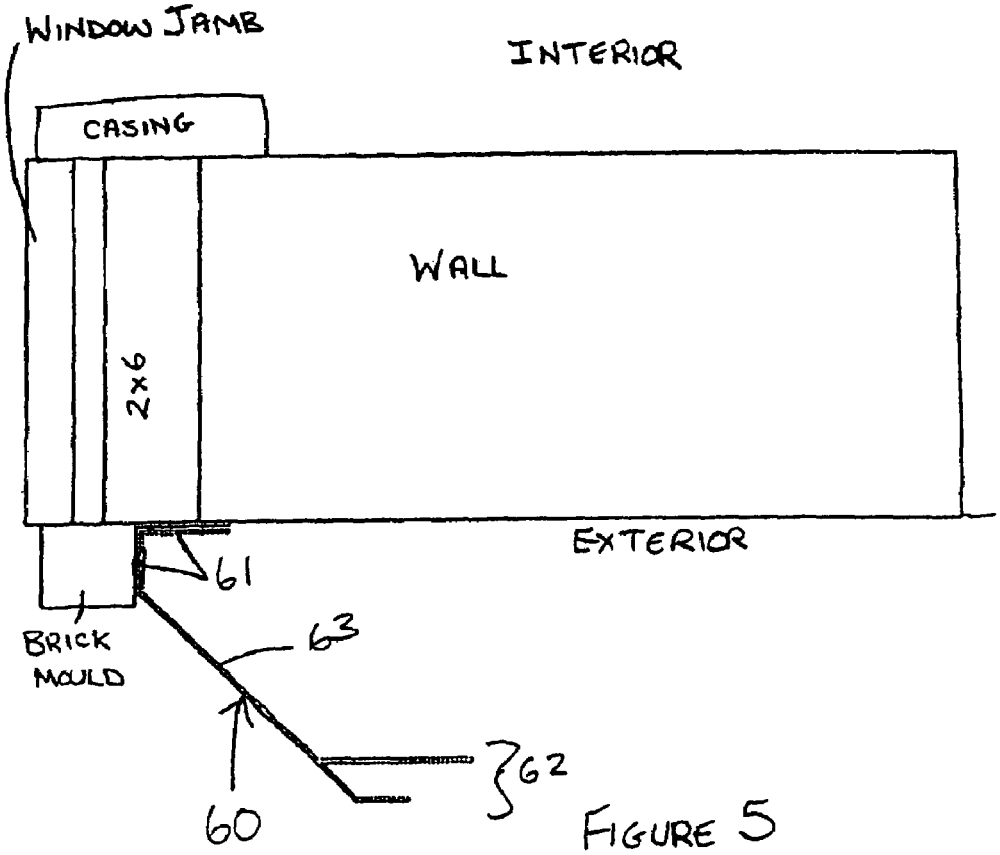
FIG. 5 shows an embodiment of a brick mould abutting trim in accordance with the invention.

Similarly, when using the stud system on the exterior of a wall near a window, another type of specialty trim member may be required. For example, as shown in FIG. 5, a window jamb trim member 60 is provided having a brick mould abutment surface 61 for affixing to the brick mould surrounding a window, a J-member 62 for affixing an exterior finish such as siding, and a connector web 63 extending from the brick mould to the J-member. The trim member may also provide an integral component of the window jamb.

Alternate Embodiments

Figure 1A:
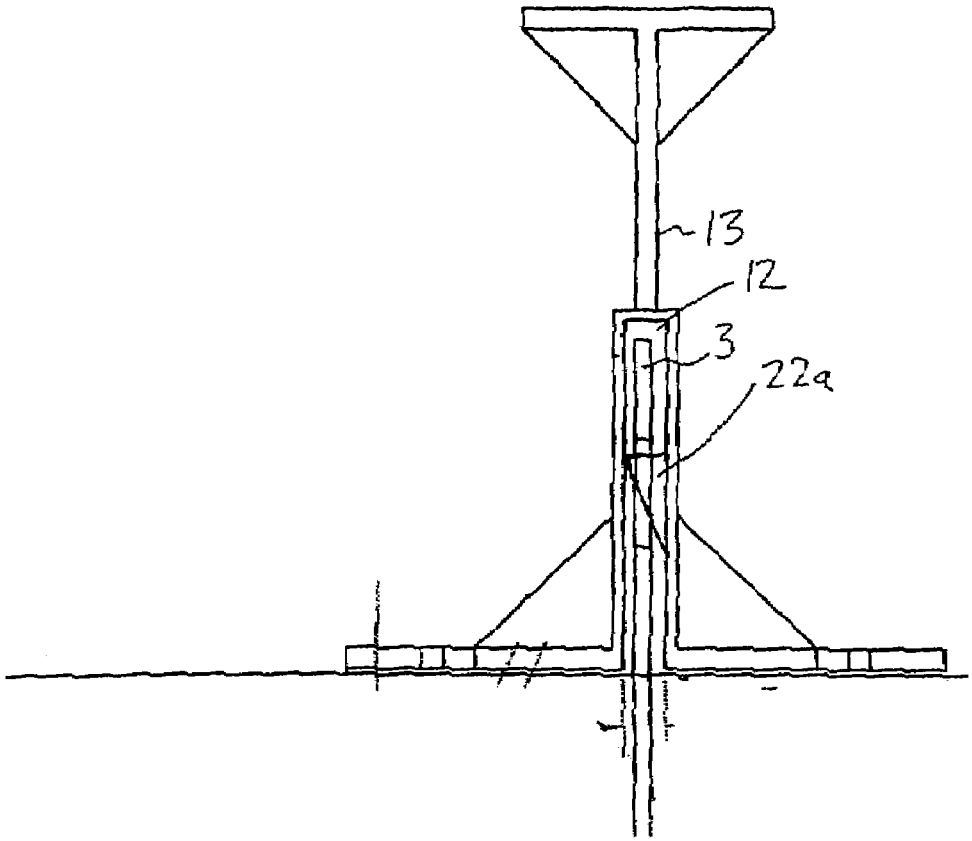
FIG. 1A is a cross sectional view of an alternate embodiment of the invention showing a resiliently-flexible tab.
Figure 1B:
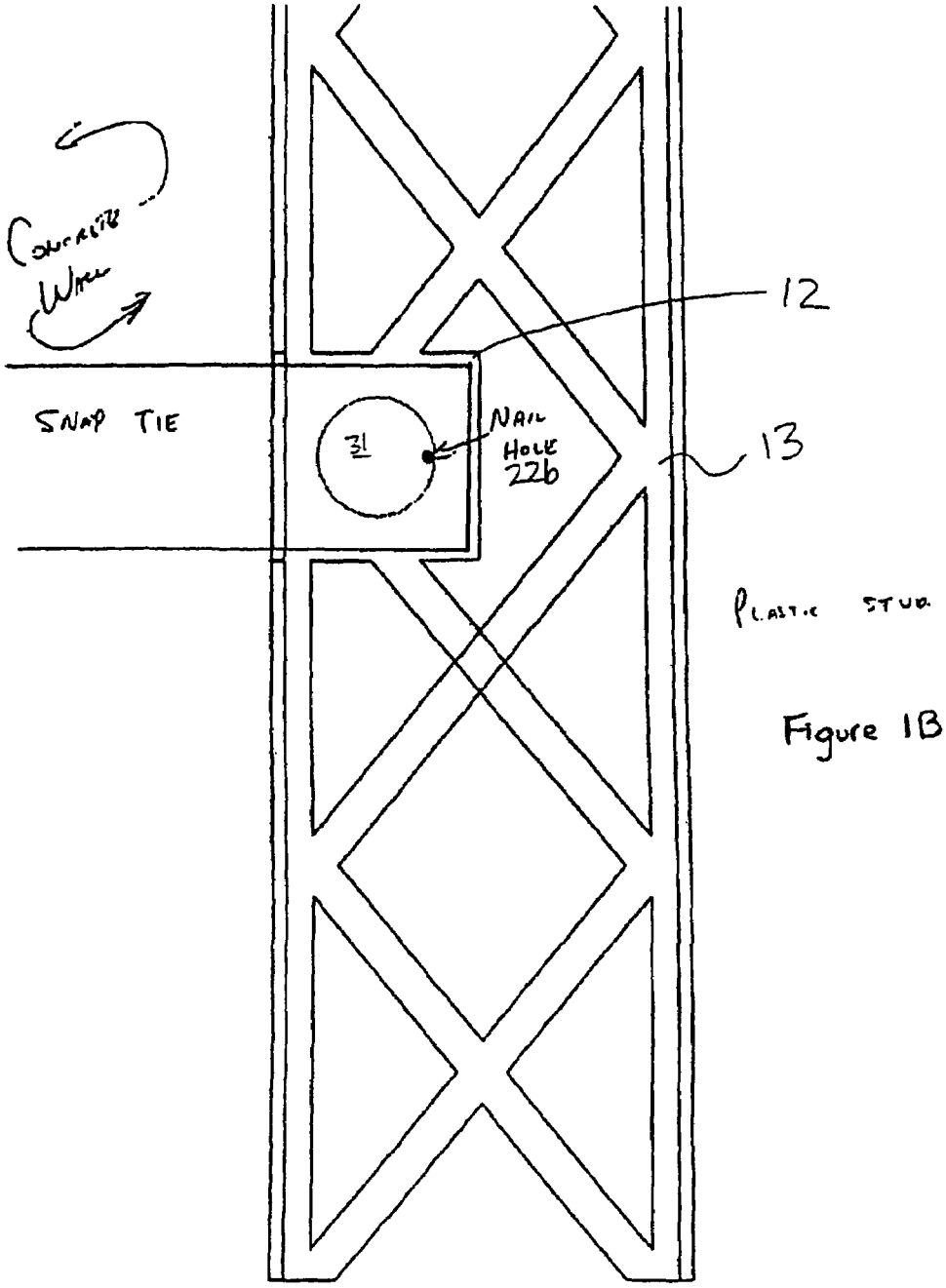
FIG. 1B is a side view of an alternate embodiment of the invention showing a nail hole.

It is recognized that certain elements described above may be substituted without departing from the spirit and scope of the invention. For example, the receptacle opening 21 and anchor 22 may be replaced by a receptacle 12 having an inwardly projecting resiliently-flexible tab 22*a* for engagement with the tie hole 31 (as shown in FIG. 1A) or the anchor may be replaced, for example, by a clip or by a rod extending through the openings 21 of several studs 1. A further embodiment is shown in FIG. 1B where the receptacle 12 is provided with a nail hole 22*b*, through which a nail may be placed so as to pass through the snap-tie hole 31 to secure the stud.

Moreover, a stud may have any number of flanges or receptacles, and it is not required that a stud be secured to the wall at each flange or receptacle, only that the stud is sufficiently secured to the wall to support the foam insulation as well as attachment of an exterior finish, if desired.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A longitudinal stud for use with a concrete wall for supporting and retaining curable foam insulation adjacent the concrete wall, the stud comprising a longitudinal member having a length dimension greater than a width and depth dimension, the longitudinal member including:

a longitudinal first surface for abutting against a concrete wall;

an anchoring system for anchoring the first surface to at least two form ties protruding from the concrete wall; and a lateral web extending from the first surface for receiving and retaining curable foam insulation adjacent to the concrete wall wherein the lateral web allows fluid communication of the curable foam insulation between opposite sides of the lateral web to create a substantially continuous layer of insulation through the lateral web;

wherein the anchoring system includes at least two corresponding form tie receptacles and corresponding anchors for engaging a hole in each form tie; and wherein each anchor is a tab located within each corresponding form tie receptacle.

2. The longitudinal stud according to claim 1, further comprising a second surface disposed on the lateral web opposite to the first surface for supporting a finishing treatment.

3. The longitudinal stud according to claim 2 wherein the lateral web extends between the first and second surfaces at right angles thereto.

4. The longitudinal stud according to claim 1, wherein the first surface comprises first and second flanges extending outwardly from the lateral web.

5. The longitudinal stud according to claim 4, wherein the first and second flanges includes an aperture through which a nail may be driven to secure the flange against the concrete wall.

6. The longitudinal stud according to claim 1 wherein the stud is a moulded plastic stud.

7. A kit for finishing a surface of a concrete wall, the kit comprising a plurality of longitudinal studs wherein each longitudinal stud comprises a longitudinal member having a length dimension greater than a width and depth dimension, the longitudinal member including:

a longitudinal first surface for abutting against a concrete wall;

an anchoring system for anchoring the first surface to at least two form ties protruding from the concrete wall; and a lateral web extending from the first surface for receiving and retaining curable foam insulation adjacent to the concrete wall wherein the lateral web allows fluid communication of the curable foam insulation between opposite sides of the lateral web to create a substantially continuous layer of insulation through the lateral web;

wherein the anchoring system includes at least two corresponding form tie receptacles and corresponding anchors for engaging a hole in each form tie; and wherein each anchor is a tab located within each corresponding form tie receptacle.

8. A kit as in claim 7 further comprising an opening trim member, the opening trim member for operative engagement with a concrete wall adjacent an opening, the trim member including an abutting surface for abutting the opening in the concrete wall, an extension member extending angularly from the abutting surface a second extension member for supporting attachment of a finishing surface, the trim member also for supporting curable foam insulation adjacent the opening.

9. A kit as in claim 7 further comprising a corner stud for attachment to a wall corner, the corner stud including first and second wall contacting surfaces and first and second web surfaces extending outwardly from the first and second wall contacting surfaces, the first and second web surfaces interconnected by a hinge.

* * * * *